US007878099B2

(12) United States Patent
Loibl

(10) Patent No.: US 7,878,099 B2
(45) Date of Patent: Feb. 1, 2011

(54) ROTARY CUTTING UNIT FOR TRIMMING SHEET MATERIAL

(75) Inventor: Bernd Loibl, Klettgau (DE)

(73) Assignee: Monolith GmbH Burosysteme, Neuss (DE)

( * ) Notice: Subject to any disclaimer, the term of this patent is extended or adjusted under 35 U.S.C. 154(b) by 229 days.

(21) Appl. No.: 11/808,758

(22) Filed: Jun. 12, 2007

(65) Prior Publication Data

US 2008/0034936 A1 Feb. 14, 2008

(30) Foreign Application Priority Data

Jun. 14, 2006 (DE) ..... 20 2006 009 493

(51) Int. Cl.
*B26D 7/02* (2006.01)
*B26D 1/18* (2006.01)

(52) U.S. Cl. ..... 83/455; 83/485; 83/614

(58) Field of Classification Search ..... 83/455, 83/485, 614
See application file for complete search history.

(56) References Cited

U.S. PATENT DOCUMENTS 5,287,783 A * 2/1994 Mori ..... 83/455
5,365,820 A * 11/1994 Mori ..... 83/455
5,671,647 A * 9/1997 Mori ..... 83/56
5,996,459 A * 12/1999 Cornell et al. ..... 83/485
6,966,247 B2 * 11/2005 Tseng ..... 83/455
7,032,489 B1 * 4/2006 Lin ..... 83/485
7,131,363 B2 * 11/2006 Tseng ..... 83/455
7,409,898 B2 * 8/2008 Yeghiayan et al. ..... 83/455
2002/0092396 A1 * 7/2002 Hsiao ..... 83/614
2004/0221703 A1 * 11/2004 Loibl ..... 83/485
2004/0226426 A1 * 11/2004 Tseng ..... 83/455
2005/0039589 A1 * 2/2005 Mori et al. ..... 83/614
2005/0120850 A1 * 6/2005 Loibl ..... 83/485
2005/0199116 A1 * 9/2005 Loibl ..... 83/614
2006/0090621 A1 * 5/2006 Shimizu ..... 83/455
2006/0117925 A9 * 6/2006 Volfson et al. ..... 83/485
2006/0213348 A1 * 9/2006 Loibl ..... 83/651
2006/0254720 A1 * 11/2006 Loibl ..... 156/530
2006/0266191 A1 * 11/2006 Shih ..... 83/614
2007/0125214 A1 * 6/2007 Dong et al. ..... 83/485
2007/0131073 A1 * 6/2007 Loibl ..... 83/614
2007/0157783 A1 * 7/2007 Chiang ..... 83/485
2007/0261529 A1 * 11/2007 Schulz ..... 83/614
2008/0250909 A1 * 10/2008 Sudmalis et al. ..... 83/455
2008/0264227 A1 * 10/2008 Sudmalis et al. ..... 83/614

(Continued)

FOREIGN PATENT DOCUMENTS

EP 1867448 A1 * 12/2007

*Primary Examiner*—Jason Daniel Prone
(74) *Attorney, Agent, or Firm*—Berenato & White, LLC

(57) ABSTRACT

A rotary cutting unit for trimming sheet material has a support plate for receiving the sheet material. The rotary cutting device having a guide bar with a displaceably guided knife carriage. A rotary knife is rotatably mounted on the knife carriage. The guide bar is guided between an initial raised position and a lowered clamping position. The guide bar includes a clamping surface for contact against sheet material. The guide bar has a force impinged upon it by a spring device, in the direction toward the initial position. An actuation device moves the guide bar out of the initial position into the clamping position. The guide bar is clamped in vertically movable fashion between the spring device and a further spring device. The second spring device has a spring action directed oppositely to the first.

18 Claims, 3 Drawing Sheets

U.S. PATENT DOCUMENTS

2009/0000442 A1* 1/2009 Peterson et al. ..... 83/614
2009/0013844 A1* 1/2009 Sudmalis et al. ..... 83/614
2009/0126547 A1* 5/2009 Loibl ..... 83/614
2009/0158909 A1* 6/2009 Loibl ..... 83/687
2009/0211420 A1* 8/2009 Loibl ..... 83/485
2009/0293694 A1* 12/2009 Petersen et al. ..... 83/614
2010/0132522 A1* 6/2010 Peterson et al. ..... 83/485

* cited by examiner

ROTARY CUTTING UNIT FOR TRIMMING SHEET MATERIAL

FIELD OF THE INVENTION

The present invention relates to a rotary cutting unit for trimming sheet material.

BACKGROUND OF THE INVENTION

Cutting units are used chiefly in the office sector to trim sheets of paper or film, either individually or as a stack of sheet material. A feature common to such cutting units is that they have a horizontal support plate for placement of the sheet material, and that a cutting device is provided on at least one side of the support plate. Rotary cutting devices are suitable for producing particularly smooth cut edges.

A rotary cutting device comprises a guide bar that extends parallel to one side of the support plate and also parallel to the surface of the support plate. A knife carriage is guided on the guide bar, displaceably along the guide bar. The knife carriage comprises a rotary knife that is mounted, freely rotatably about an axis extending horizontally and transversely to the longitudinal axis of the guide bar, on the knife carriage. Usually the knife carriage itself, or the part of the knife carriage on which the rotary knife is mounted, can be lowered vertically from above onto the support plate by exerting pressure.

For a cutting operation, the sheet material is placed onto the support plate and is slid through beneath the guide bar until the portion to be cut off protrudes on the other side of the guide bar. Vertical pressure is then exerted on the knife carriage so that the rotary knife is lowered toward the sheet material. Cutting of the sheet material is then accomplished by displacing the knife carriage along the guide bar. The rotary knife performs a rotary motion in this context, and thereby cuts the sheet material.

To eliminate the need to hold the sheet material with the other hand during the cutting operation, a variety of solutions have been found with which the sheet material can be clamped against the support plate. In the rotary cutting units according to U.S. Pat. Nos. 5,671,647 A and 5,365,820 A, the guide bars rest on a spring device having end-located spring members that are braced on the support plate. When pressure toward the support plate is exerted on the knife carriage during the cutting operation, the guide bar is pushed downward into a clamping position and thereby grips the sheet material between the guide bar and support plate.

The rotary cutting unit according to U.S. Pat. No. 6,966,247 B2 is similar in its action. Here the guide bar is attached at its ends rigidly to the support plate, but located beneath the guide bar is a vertically movable clamping bar that, in the initial position, is clamped via tension springs against the underside of the guide bar. The knife carriage is divided into a guidance part and a knife part, the knife part having the rotary knife being vertically displaceable with respect to the horizontally extending guide bar. When vertical pressure is exerted on the knife carriage, its movable part is lowered toward the support plate and the clamping bar is carried along. The latter then abuts against the sheet material to be trimmed, and immobilizes it.

A disadvantage of the rotary cutting units described above is that clamping of the sheet material is dependent on the action on the knife carriage, i.e. clamping is not accomplished until the cutting operation begins, and moreover is locally concentrated on the position of the knife carriage. Prior to the cutting operation, shifting of the sheet material can therefore still occur.

To avoid this, rotary cutting units have been developed that effect a clamping of the sheet material independently of the actuation of the knife carriage (cf. U.S. Pat. Nos. 5,069,097 A and 5,287,783 A). In the context of their rotary cutting devices, a clamping bar is likewise arranged beneath the guide bar and is suspended from the guide bar by springs. The guide bar itself is vertically movable between a raised initial position and a final position. Before a cutting operation and after positioning of the sheet material, the guide bar is lowered from the initial position toward the support plate and the sheet material until it has reached the final position. The clamping bar is thereby set onto the sheet material and clamps it against the support plate. The clamping pressure is applied by the springs between the guide bar and clamping bar. In the final position, the guide bar is held at its ends, via guidance devices and immobilization devices, in a position that is always the same and is therefore independent of the thickness of the sheet stack.

In the embodiment according to U.S. Pat. No. 5,069,097 A, the guidance device is embodied on one side of the guide bar as a pivot joint by means of which the guide bar can be pivoted upward in lever fashion. In the initial position, the guide bar on the other side is located outside the guidance device and latches therewith once the final position is assumed. In the embodiment according to U.S. Pat. No. 5,287,783 A, actuation devices are provided on both sides; with said devices, the guide bar can be transported out of an initial position parallel to the support plate into the final position, where it is immobilized.

The above-described rotary cutting units secure the sheet material in position independently of the cutting operation, but are of relatively complex construction and therefore expensive and prone to malfunction.

With the rotary cutting unit according to US 2005/0120850 A1, a solution has been found that eliminates the aforesaid disadvantages. With this rotary cutting device, once again the guide bar itself serves as a clamping device to clamp the sheet material against the support plate. For this purpose, the guide bar is held at both ends in guidance devices, in a first embodiment on one side via a pivot joint and on the other side in substantially vertically displaceable fashion, and in a second embodiment vertically displaceably on both sides. Wherever the guide bar is vertically movable, a respective actuation device is provided with which the guide bar can be brought out of the initial position, in which its lower-side clamping surface is at a distance from the support plate, into a clamping position in which the clamping surface rests with a preload on the support plate or, when sheet material has been slid under, on that material itself and clamps it against the support plate. An immobilization device in the form of a latching device ensures that the guide bar, once having assumed the clamping position, maintains it independently of the cutting operation. Only by releasing the latching device(s) is the guide bar again lifted away from the sheet material into the initial position, specifically by means of spring members of a spring device.

The above-described rotary cutting unit is notable for a simple design configuration. It is necessary, however, to accept that, because of the defined clamping position of a guide bar, only a small number of sheets can be trimmed simultaneously.

SUMMARY OF THE INVENTION

It is thus the object of the present invention to configure a rotary cutting unit so that with it, clamping of the sheet material is possible before the beginning of the cutting operation; it is of simple design and therefore inexpensive; and it is also suitable for trimming relatively thick sheet material or a relatively thick sheet material stack.

This object is achieved, according to the present invention, by the following features:

m) the guide bar is clamped in vertically movable fashion between the (first) spring device and a further (second) spring device;

n) the second spring device has a spring action directed oppositely to the first;

o) the actuation device acts on the guide bar by means of the second spring device.

The basic idea of the invention is therefore to guide the guide bar in sprung fashion in both directions, i.e. away from and toward the support plate, so that the connection that exists to the actuation device is not direct but only via the second spring device. Upon impingement of a force on the actuation device for the purpose of moving the guide bar out of the initial position into the clamping position, the force is transferred in sprung fashion to the guide bar via the second spring device. When the guide bar is abutting against the sheet material, the actuation device can be moved, against the action of the second spring device, even farther into the final position that is provided, and can be immobilized there. The clamping position of the guide bar is thus variable in accordance with the thickness of the respective sheet material to be trimmed, and is thus independent of the final position of the actuation device. The clamping force rises with the thickness of the sheet material, or sheet material stack, that is to be trimmed. In contrast to the rotary cutting units according to U.S. Pat. Nos. 5,069,097 A and 5,287,783 A, the rotary cutting device according to the present invention is notable for a simple configuration, since a separate clamping bar and its suspension system on the guide bar are not present, and instead the guide bar itself is employed to clamp the sheet material.

The basic idea of the present invention can be realized in two ways. In a first embodiment, the guide bar is operated from only one end. The actuation device has, for this purpose, an actuation member only on a single guidance device, and the first spring device is arranged only on that guidance device, whereas the second spring device is effective in the direction toward the support plate in the region of both guidance devices, on the one hand between the actuation member and guide bar and on the other hand between the guidance device and guide bar. The second spring device presses the guide bar in its initial position onto the support plate in the region of the guidance device, not having an actuation device.

With this embodiment the guide bar, in the initial position, is pivoted upward around the guidance device not having an actuation device, and thus opens up a gap between the clamping surface of the guide bar and the support plate, so that sheet material can be slid through there under the guide bar. For clamping of the sheet material, the actuation member is pushed downward with the result that the guide bar abuts, with the clamping surface, against the sheet material against the action of the second spring device; the end of the guide bar that is guided in the guidance device not having an actuation member rises away from the support plate, against the action of the second spring device, to adapt to the surface of the sheet stack. It is understood that the second spring device is embodied so that as the actuation member moves farther toward its final position, the guide bar or its clamping surface remains in planar contact against the sheet material and thus in a horizontal position. This can occur by appropriate adaptation of spring members of the second spring device in the region of both guidance devices.

In a second embodiment, preference is given to a symmetrical embodiment of the rotary cutting device. With this embodiment the actuation device comprises actuation members on both guidance devices, which each coact with an immobilization device, preferably so that they immobilize the actuation devices in the final position at identical distances from the support plate.

With this embodiment, the motion of the guide bar out of the initial position into the clamping position is therefore produced by the fact that actuation devices are actuated manually at both ends; this can occur successively or simultaneously. This embodiment has the advantage that a particularly uniform contact of the guide bar on the sheet material can be effected.

Irrespective of the basic embodiment of the rotary cutting device, the second spring device should comprise at least one spring member that is arranged respectively in the region of the pertinent guidance device. As regards the first spring device, once again at least one spring member should be provided, specifically in the respective guidance device equipped with an actuation device. The spring members are usefully embodied as helical springs that are preferably compression-loaded. The spring members of the first and the second spring device are usefully arranged within the guidance device(s) in such a way that they are located vertically opposite one another.

In a manner known per se, the spring member or members of the first spring device should act on the first spring device on the underside of the guide bar, in which context the spring member or members can be braced against the support plate. The spring members of the second spring device usefully act on the upper side of the guide bar.

The immobilization device(s) is/are embodied, in a manner known per se, as (a) latching device(s) with which the respectively pertinent actuation device automatically latches in the final position. The latching device(s) should each comprise an operating member by whose actuation the latched position is disengageable. The actuation device can comprise at least one actuation member that is embodied as a pushbutton guided vertically in the respective guidance device.

Lastly, provision is made according to the invention for the rotary knife to be lowerable with respect to the guide bar, toward the support plate, against the action of a return spring, for example by the fact that the entire knife carriage is retained in vertically movable fashion on the guide bar, or only the part on which the rotary knife is mounted and which is movable vertically, via a corresponding handle, with respect to the remaining part of the knife carriage.

BRIEF DESCRIPTION OF THE DRAWINGS

The invention is further illustrated, with reference to an exemplifying embodiment, in the drawings, in which.

DETAILED DESCRIPTION OF THE PREFERRED EMBODIMENT(S)

Figure 1:
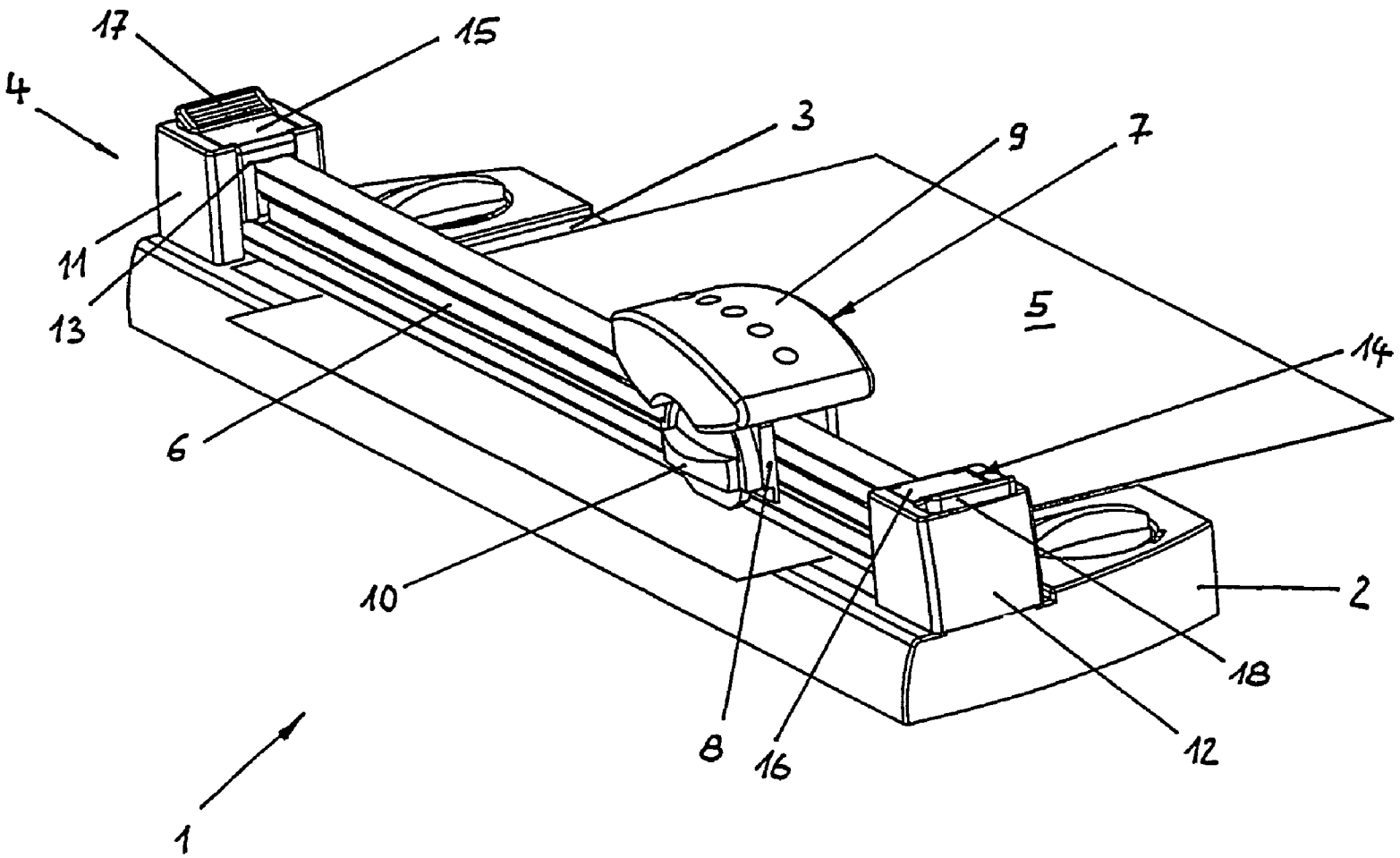
FIG. 1 is an oblique view from above of the rotary cutting device according to the present invention.

Rotary cutting unit 1 depicted in FIG. 1 comprises a support plate 2 that has on the upper side a horizontal sheet support surface 3. Arranged in the region of a longitudinal side of support plate 2 is a rotary cutting device 4 that serves to trim sheet material 5 placed on sheet support surface 3.

Rotary cutting device 4 comprises a guide bar 6 extending parallel to the longitudinal side of support plate 2 and parallel to sheet support surface 3; wrapping around both sides of said bar from the top is a knife carriage 7 that is displaceable along guide bar 6.

Knife carriage 7 is divided into an internally located guidance part (which is therefore not visible here) that fits positively around guide bar 6, and an external knife part 8 that is movable out of the raised position shown, against the action of a spring that is not visible here, vertically downward into a cutting position. Knife carriage 7 has at the top, for handling thereof, a hand grip 9 that is intended as a hand support and with which knife carriage 7 can be displaced along guide bar 6 and simultaneously lowered downward. Knife part 8 has a rotary knife concealed by a knife cover 10, which knife protrudes at the bottom slightly beyond knife cover 10 and sits in freely rotatable fashion on a knife axis extending horizontally and transversely to the longitudinal axis of guide bar 6.

Guide bar 6 projects at both ends into guide blocks 11, 12, in which guide bar 6 is laterally guided and is at the same time vertically movable. Guide blocks 11, 12 are joined rigidly to support plate 2. Actuation members 13, 14 are guided, once again laterally and vertically movably, in guide blocks 11, 12. Actuation members 13, 14 grip the ends of guide bar 6 on the upper side, at the end face, and on both vertical sides. At the top, actuation members 13, 14 comprise flat actuation flanges 15, 16 with which pressure can be exerted manually in the direction of sheet support surface 3.

A respective latching member 17, 18 is arranged behind each actuation member 13, 14. Latching members 17, 18 are mounted in guide blocks 11, 12, horizontally displaceably parallel to guide bar 6. They can therefore each be displaced outward, out of the latched position shown, into an unlatched position.

Figure 2:
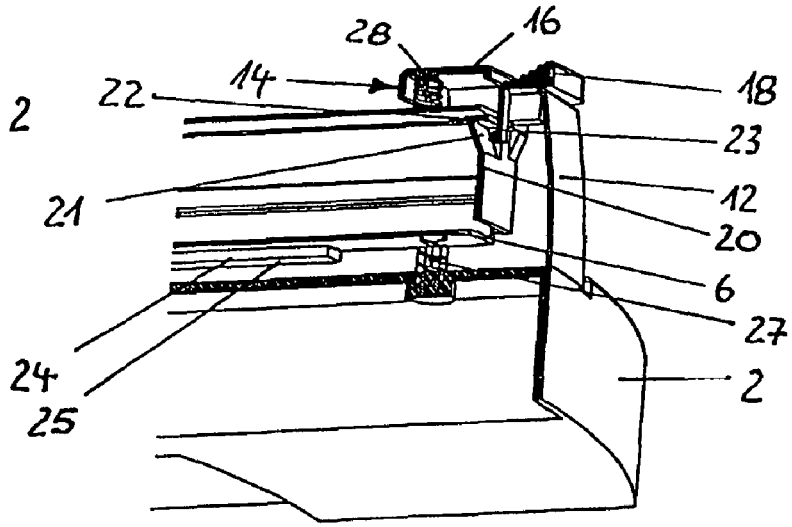
FIG. 2 is a vertical section through the right-hand end of the rotary cutting device according to FIG. 1, in an oblique view with the guide bar in the initial position.
Figure 3:
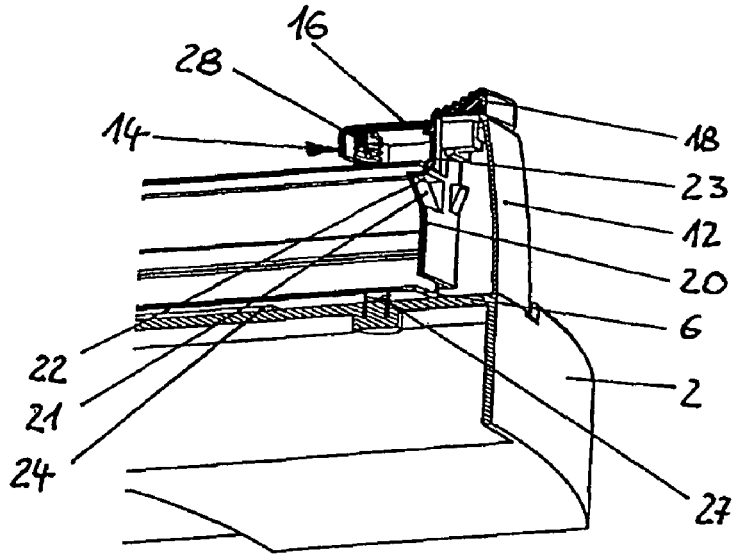
FIG. 3 shows the rotary cutting device as depicted in FIG. 2 with the guide bar in the clamping position, with a thin sheet material.
Figure 4:
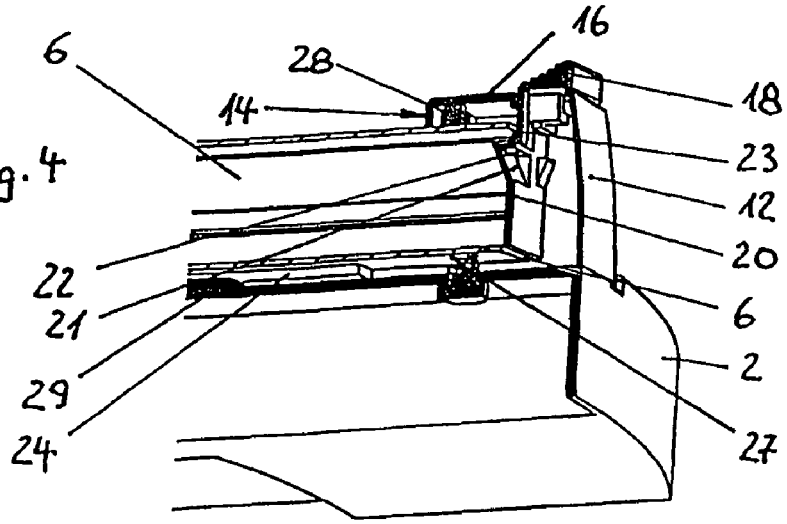
FIG. 4 shows the rotary cutting device as depicted in FIGS. 2 and 3 with the guide bar in the clamping position, with a relatively thick sheet material.

FIGS. 2 to 4 indicate, on the basis of sectioned views limited to the right-hand portion, more detail as to the configuration and coaction of actuation members 13, 14 and latching members 17, 18. Rotary cutting unit 1 is embodied in mirror-image fashion at the left end, so that the statements below also apply analogously to the description of the left end of guide bar 6.

Actuation member 14 is partially visible in FIGS. 2 to 4, with actuation flange 16 at the top and latching element 20 shaped thereonto and fitting around the end face of guide bar 6. Latching element 20 comprises a wedge-shaped latching depression 21 that is closed off at the top by a latching flange 22. The latter coacts with a latching lug 23 that projects downward, from the part of latching member 18 that projects at the top, into the space enclosed by guide block 12. Acting on latching lug 23 is the spring element already discussed above, which impinges upon latching lug 23, and thus on latching member 18, in the direction toward the end face of guide bar 6 and toward actuation member 14.

Guide bar 6 is made up substantially of an aluminum profile. It comprises at the bottom a clamping strip 24, made of elastomeric plastic, that extends over the width of sheet support surface 3. The underside of clamping strip 24 forms a clamping surface 25.

Guide bar 6 is acted upon on the underside at each end, in the region of guide blocks 11, 12, by a respective compression spring 27. The two compression springs 27 are each braced against support plate 2 in a mirror-symmetrical arrangement.

A respective second compression spring 28 is arranged between the upper side of guide bar 6 and the underside of actuation flanges 15, 16. Guide bar 6 is therefore not joined rigidly at both ends to actuation members 13, 14, but instead is clamped in by compression springs 27, 28 acting respectively in opposite directions, and is therefore guided movably with respect to both support plate 2 and actuation members 13, 14.

Figure 5:
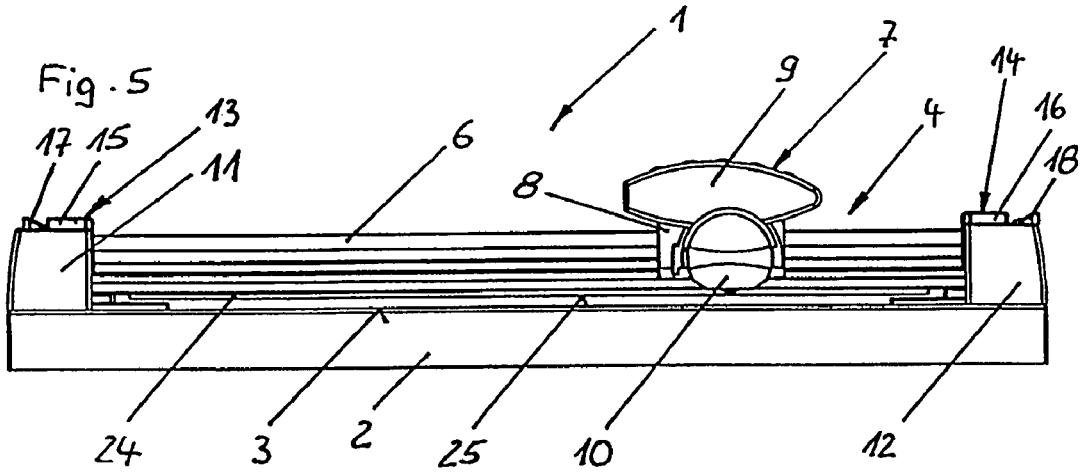
FIG. 5 is a side view of the rotary cutting device according to FIGS. 1 to 4 with the guide bar in the initial position.

Before a cutting operation, guide bar 6 is in a raised initial position. This is visible in FIGS. 2 and 5. In this starting position, clamping surface 25 is spaced well away from sheet support surface 3. In this initial location, guide bar 6 is braced at the ends on first compression springs 27. It is pushed by these springs 27 toward second compression springs 28, which in turn are braced against the undersides of actuation flanges 15, 16. Actuation members 13, 14 likewise assume an initial position in which they protrude upward beyond the surface of guide blocks 11, 12. Latching lugs 23 project into the respectively associated latching depressions 21 of latching elements 20.

Figure 6:
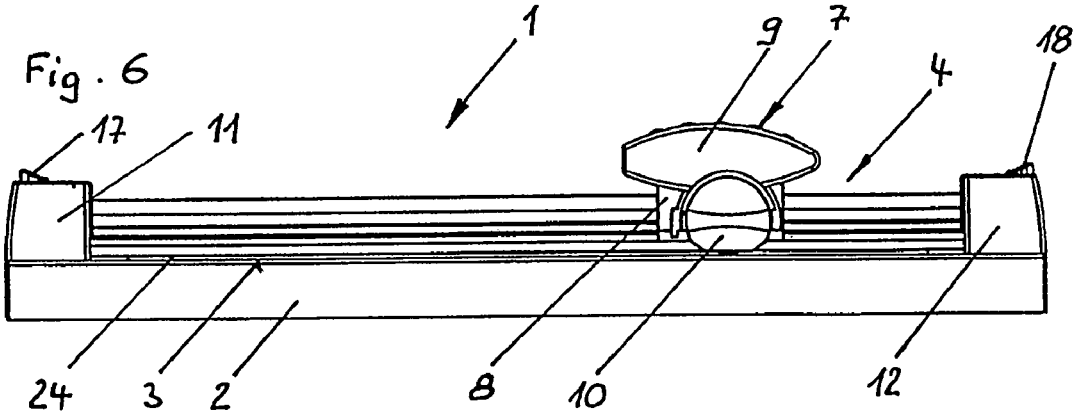
FIG. 6 is the side view according to FIG. 5 of the rotary cutting device with the guide bar in the clamping position, with a thin sheet material.

When sheet material 5 is to be trimmed, it is placed onto sheet support surface 3 (as is shown in particular in FIG. 1) and is then slid through the gap between guide bar 6 and sheet support surface 3 until it protrudes on the other side, beyond the plane of the rotary knife, to the distance to which it is to be trimmed. Guide bar 6 is then pushed down in order to clamp sheet material 5 in linear fashion between clamping surface 25 and sheet support surface 3. This will be explained first with regard to trimming of a single sheet, with reference to FIGS. 3 and 6.

In order to lower guide bar 6, the two actuation members 13, 14 are pushed downward by impinging upon actuation flanges 15, 16. Because second compression springs 28 have a higher spring constant than first compression springs 27, this compresses first compression springs 27 for the most part, and second compression springs 28 only very slightly. This continues until clamping surface 25 comes into contact with sheet material 5. Because of the resistance, guide bar 6 cannot be moved farther, i.e. it has reached its clamping position. Latching members 17, 18, however, have not yet reached their final position, i.e. they are moved even farther downward against the resistance of second compression springs 28, until latching flanges 22 of latching depressions 21 end up underneath latching lugs 23. This produces a clearly audible click. Latching lugs 23 now block the ability of actuation members 13, 14 to move upward. The clamping force exerted by guide bar 6 on sheet material 5 is determined substantially by second compression springs 28. In order to distribute the pressure uniformly over the length of the guide bar, compression springs 28 are embodied identically and are arranged at identical distances from the center of guide bar 6. At the same time, second compression springs 28 press latching flanges 22 with their upper sides against the lower sides of latching lugs 23.

Figure 7:
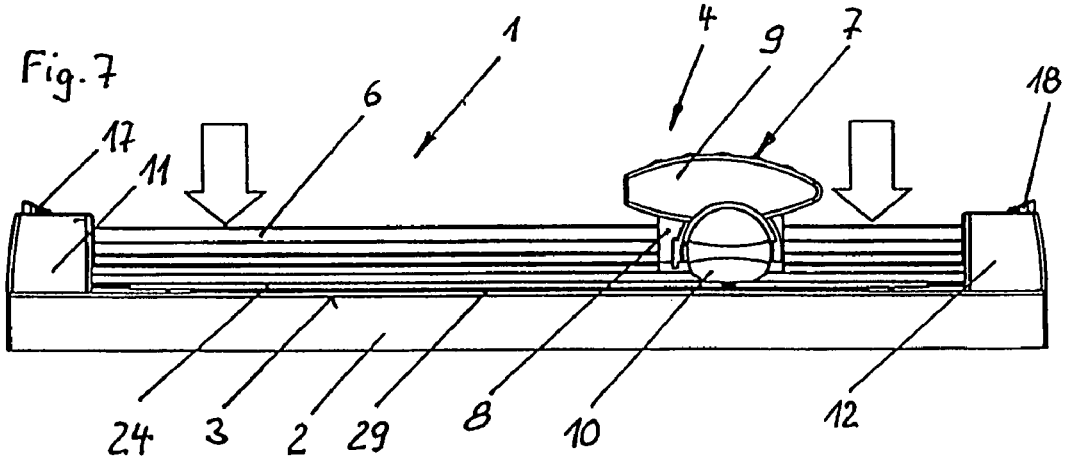
FIG. 7 is the view according to FIGS. 5 and 6 of the rotary cutting device with the guide bar in the clamping position, with a relatively thick sheet material.

The clamping of a thicker sheet material stack 29, as shown in FIGS. 4 and 7, proceeds no differently in principle. The difference is that guide bar 6 comes into contact with sheet material stack 29 substantially earlier, and therefore assumes a clamping position that greater by an amount equal to the thickness of sheet material stack 29. This is shown by a comparison of FIGS. 3 and 6 on the one hand with FIGS. 4 and 7 on the other hand.

In order for actuation members 13, 14 to reach their above-described final position, they must be pushed down just as far as in the case of trimming a single sheet. Second compression springs 28, however, are compressed substantially more strongly, as is likewise shown by a comparison between FIGS. 3 and 6 on the one hand and 4 and 7 on the other hand. Also correspondingly higher is the clamping force exerted on sheet material stack 29 when latching members 17, 18 have reached the final position, depicted in FIGS. 4 and 7, in which latching flanges 22 abut at the bottom against latching lugs 23. In both cases, the surfaces of actuation flanges 15, 16 terminate flush with the upper sides of guide blocks 11, 12, i.e. actuation members 13, 14 have a defined final position, in contrast to the clamping position of guide bar 6, which depends on the thickness of sheet material 5.

For the cutting operation itself, after the clamping of sheet material 5 or sheet material stack 29, knife part 8 is pushed downward by manual impingement upon handle 9 so that the downwardly protruding rotary knife pushes into sheet material 5 or sheet material stack 29. The cutting operation is carried out by displacing knife carriage 7 along guide bar 6 over the entire width of sheet material 5 or sheet material stack 9.

After completion of the cutting operation, the now-trimmed sheet material 5 or sheet material stack 29 is still clamped between guide bar 6 and sheet material support 3. To release the clamping, latching members 17, 18 are displaced outward by the exertion of pressure in the direction away from guide bar 6, against the action of the latter's spring elements, until latching lugs 23 come out of engagement with latching flanges 22. Actuation members 13, 14 can now be moved upward back into their initial position (FIGS. 2 and 5), which results in relaxation of compression springs 27, 28. Compression springs 27 ensure that guide bar 6 is raised into the initial position according to FIGS. 2 and 5. Sheet material 5 or sheet material stack 29 is now free and can be removed.

The invention claimed is:

1. A rotary cutting unit for trimming sheet material, comprising:

a support plate for receiving the sheet material;

a rotary cutting device is joined to the support plate;

the rotary cutting device comprises a guide bar;

a knife carriage is guided on and displaceable along the guide bar;

a rotary knife is rotatably mounted on the knife carriage;

the guide bar is held at one end by a first guidance device and at a second end by a second guidance device;

the guide bar is guided in the guidance devices movably between an initial position raised with respect to the support plate and a clamping position lowered in a direction toward the support plate;

the guide bar comprises a lower side which acts as a clamping surface for contact against the sheet material;

a first spring device acts on the guide bar in a direction toward the initial position;

an actuation device for moving the guide bar out of the initial position into the clamping position;

the actuation device is movable between a starting position in which the guide bar is in the initial position, and a final position in which the guide bar is in the clamping position;

the actuation device comprises an immobilization device that releasably immobilizes the actuation device in the final position, wherein the guide bar is clamped in vertically movable fashion between the first spring device and a second spring device;

the second spring device has a spring action directed oppositely to the first spring device;

the actuation device acts on the guide bar by means of the second spring device.

2. The rotary cutting unit according to claim 1, wherein the actuation device comprises actuation members on said first and second guidance devices, wherein the immobilization device comprises a first and second immobilization device, wherein each of said actuation members coact with a respective one of said first and second immobilization devices.

3. The rotary cutting unit according to claim 2, wherein the immobilization devices immobilize the actuation members in the final position at identical distances from the support plate.

4. The rotary cutting unit according to claim 3, wherein the rotary cutting device is embodied in mirror-symmetrical fashion with respect to the a center of the guide bar.

5. The rotary cutting unit according to claim 1, wherein the second spring device comprises at least one spring member that is arranged in a region of a pertinent one of said guidance devices.

6. The rotary cutting unit according to claim 5, wherein the first and second spring device are located opposite one another.

7. The rotary cutting unit according to claim 5, wherein the at least one spring member of the second spring device acts on an upper side of the guide bar.

8. The rotary cutting unit according to claim 1, wherein the first spring device comprises at least one spring member in a respective one of said guidance devices which is equipped with said actuation device.

9. The rotary cutting unit according to claim 8, wherein the at least one spring member of the first spring device acts on the lower side of the guide bar.

10. The rotary cutting unit according to claim 1, wherein the immobilization device is embodied as a latching device with which the actuation device automatically latches in the final position.

11. The rotary cutting unit according to claim 10, wherein the latching device comprises an operating member by whose actuation the latching device is disengageable.

12. The rotary cutting unit according to claim 1, wherein said immobilization device comprises a latching element having a wedge-shaped latching depression and a latching flange which is engaged by a latching lug projecting from said actuation device.

13. The rotary cutting unit according to claim 12, wherein the actuation device comprises a pushbutton operably associated with said latching lug, the activation of said pushbutton disengaging said latching lug from said immobilization device.

14. The rotary cutting unit according to claim 12, wherein said guide bar is displaceable in a vertical direction only.

15. The rotary cutting unit according to claim 1, wherein said first and second spring devices have a first end and a second, the first end of said first spring device in contact with said support plate and the second end of said first spring device in contact with said guide bar, the first end of said second spring device being in contact with said guide bar and the second end of said second spring device being in contact with said actuation device.

16. A rotary cutting unit for trimming sheet material comprising:

a support plate for receiving sheet material;

a rotary cutting device joined to the support plate, said the rotary cutting device comprises a guide bar;

a knife carriage guided on and displaceable along said guide bar;

a rotary knife rotatably mounted on said knife carriage;

guidance devices holding the ends of said guide bar and said guide bar is guided in the guidance devices movably between an initial position raised with respect to said support plate and a clamping position lowered in a direction toward said support plate;

said guide bar having a lower side;

an elastomeric strip attached directly to and in surface to surface contact with the lower side of said guide bar;

said guide bar having a force impinged upon it by a first spring device, in a direction toward the initial position and as far thereas;

an actuation device for moving said guide bar out of the initial position into the clamping position, said actuation device being movable between a starting position in which said guide bar is in the initial position, and a final position in which said guide bar is in the clamping position; and the actuation device comprises an immobilization device that releasably immobilizes the actuation device in the final position, wherein the guide bar is clamped in vertically movable fashion between the first spring device and a second spring device;

the second spring device has a spring action directed oppositely to the first spring device; and the actuation device acts on the guide bar by means of the second spring device.

17. The rotary cutting unit according to claim 16, wherein said first and second spring devices have a first end and a second, the first end of said first spring device in contact with said support plate and the second end of said first spring device in contact with said guide bar, the first end of said second spring device being in contact with said guide bar and the second end of said second spring device being in contact with said actuation device.

18. The rotary cutting unit according to claim 17, wherein said second spring device has a higher spring constant than said first spring device.

* * * * *